United States Patent [19]

Takizawa et al.

[11] 4,204,807

[45] May 27, 1980

[54] RADIAL TURBINES

[75] Inventors: Masaaki Takizawa, Mishima; Shoji Sasaki, Susono, both of Japan

[73] Assignee: Toyota Jidosha Kigyo Kabushiki Kaisha, Toyota, Japan

[21] Appl. No.: 887,356

[22] Filed: Mar. 16, 1978

[30] Foreign Application Priority Data

Mar. 23, 1977 [JP] Japan ..... 52-32463

[51] Int. Cl.[2] ..... F01D 1/08; F01D 5/04

[52] U.S. Cl. ..... 416/188; 415/213 R

[58] Field of Search ..... 416/185, 188; 415/213 R

[56] References Cited

U.S. PATENT DOCUMENTS 2,965,287 12/1960 Schug ..... 416/188 X

FOREIGN PATENT DOCUMENTS 1403047 11/1967 Fed. Rep. of Germany ..... 416/185

2048290 4/1972 Fed. Rep. of Germany ..... 416/188

2282058 3/1976 France ..... 416/188

165038 10/1964 U.S.S.R. ..... 416/188

373438 7/1973 U.S.S.R. ..... 416/185

414426 8/1974 U.S.S.R. ..... 416/188

OTHER PUBLICATIONS

Journal of Engineering for Power–Jan. 1971, Trans. A.S.M.E., vol. 93, No. 1, pp. 81–102.

*Primary Examiner*—Everette A. Powell, Jr.

*Attorney, Agent, or Firm*—Stevens, Davis, Miller & Mosher

[57] ABSTRACT

A radial turbine having rotor blades, each positioned against the exit surface of the turbine at an angle equal to the angle of the relative velocity, between a gas flow pattern simulating the actual velocity of combustion gas flow through a space between two adjacent turbine blades and a rotating turbine rotor blade, against the turbine exit surface.

4 Claims, 4 Drawing Figures

RADIAL TURBINES

This invention relates to a radial turbine having an extremely high efficiency.

In a conventional radial turbine, the angle of rake which the velocity of outgoing combustion gas relative to a turbine rotor has against a turbine exit surface has been obtained assuming that the velocity coefficient of the rotor is constant along the radius of the turbine, and has been used for the angle of rake which a turbine blade has against the turbine exit surface. The velocity coefficient of the turbine rotor, however, generally decreases from one portion of the rotor to another that is farther from the axis of the turbine; therefore, the angle of rake which the turbine blade has against the turbine exit surface when the velocity coefficient of the rotor is constant does not always represent the actual angle of rake which the velocity of the combustion gas relative to the turbine rotor has against the turbine exit surface and which changes along the radius of the turbine. This difference has caused a reduction in the operating efficiency of a conventional radial turbine.

It is an object of this invention to provide a formula to obtain the velocity relative to a turbine rotor of combustion gas having a flow pattern highly approximate to the actual flow pattern of combustion gas discharged through a space between two adjacent turbine blades.

It is another object of this invention to provide an angle of rake which a turbine blade has against the turbine exit surface and which is highly effective to heighten the turbine efficiency by using the relative velocity obtained by attainment of the above object and to eliminate the above mentioned drawbacks of conventional turbine blades.

The invention will now be described in further detail by way of example with reference to the accompanying drawings, in which.

Figure 1:
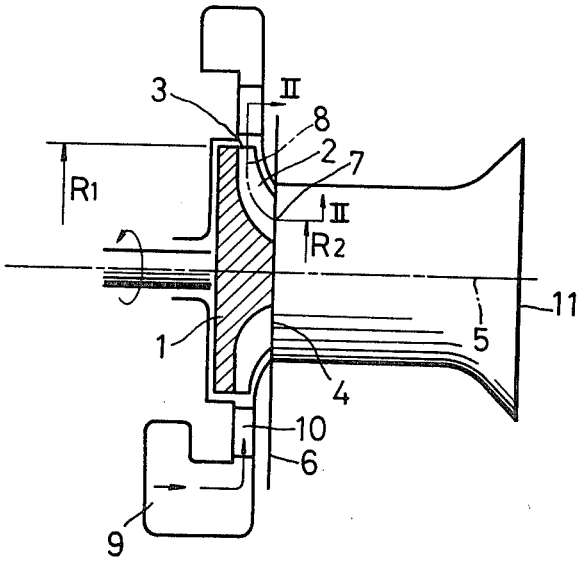
FIG. 1 is a schematic cross sectional view of the radial turbine embodying this invention.
Figure 2:
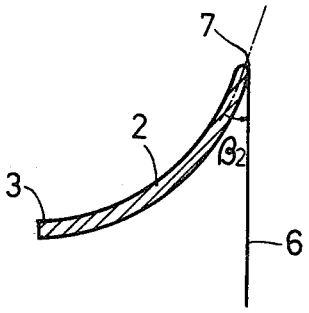
FIG. 2 is a cross sectional view of a turbine blade taken along the line II—II of FIG. 1.

Referring to FIG. 1, combustion gas from a combustion chamber, which is not shown, enters a rotor 1 through an inlet plenum 9, a nozzle 10 and an entrance portion 3, passes through spaces defined by turbine blades 2 at a high speed, while rotating the rotor 1 at a high speed, and flows out in whirls from the rotor 1 along the axis 5 of the turbine through an exit surface 6, which is a surface perpendicular to the axis 5 of the turbine at an exit portion 4.

When the radius of the rotor 1 at the turbine entrance portion 3 is indicated as $R_1$ and the radius of the rotor 1 or distance between the axis 5 of the turbine and an intersecting point 7 of the turbine exit surface 6 and the cross-section 8 of the turbine blade 2 along the line II—II which is a designated center line of flow of the combustion gas flowing through the space between two adjacent turbine blades 2 is indicated as $R_2$, the velocity $W_2$ of the combustion gas relative to the turbine rotor 1 at the circular surface including the radius $R_2$ may be obtained by the following formula:

$$W_2^2 = \Psi_2^2[W_1^2 - U_1^2 + U_2^2 + 2gJC_pT_1\left\{1 - \left(\frac{P_2}{P_1}\right)^{\frac{\gamma-1}{\gamma}}\right\}] \quad (1),$$

in which $$\Psi_2 = A + B\left(\frac{R_2}{R_1}\right) + C\left(\frac{R_2}{R_1}\right)^2 \quad (2),$$

($\Psi_2$ is velocity coefficient of the rotor)

A, B and C are coefficients, $W_1$=velocity of the combustion gas relative to the turbine rotor 1 at the turbine entrance portion 3;

$U_1$=peripheral velocity of the turbine rotor 1 at the turbine entrance portion 3;

$U_2$=peripheral velocity of the turbine rotor 1 at the portion 7 of the turbine exit surface 6;

g=gravitational acceleration;

J=heat equivalent of work;

$C_p$=specific heat at constant pressure of the combustion gas;

$P_1$=pressure of the combustion gas at the turbine entrance portion 3;

$T_1$=absolute temperature of the combustion gas at the turbine entrance portion 3;

$P_2$=pressure of the combustion gas at the circular surface including the radius $R_2$ on the turbine exit surface 6;

$\gamma$=the ratio of the specific heat at constant pressure of the combustion gas to the specific heat at constant volume of the combustion gas.

Next, when the circumferential component of the relative velocity $W_2$ is indicated as $W_{2u}$ and the component thereof in the direction of the axis 5 of the turbine is indicated as $W_{2a}$, the following formulae are obtained:

$$W_{2u} = U_2 - C_{2u} \quad (3)$$

$$W_{2a} = \sqrt{W_2^2 - W_{2u}^2} \quad (4).$$

When the angle of rake of the relative velocity $W_2$ against the turbine exit surface 6 is indicated as $\beta_2'$, the angle of rake $\beta_2'$ can be obtained by the following formula:

$$\beta_2' = \tan^{-1} W_{2a}/W_{2u} \quad (5).$$

The combustion gas is exhausted from the turbine exit surface 6 in whirls as described above and when the whirls are divided and considered in the following two cases, $C_{2u}$ of the formula (3) and the coefficients A, B and C of the formula (2) are obtained as follows, respectively:

(1) When the whirl is a rigid body swirl (peripheral velocity of the whirl is proportionate to the distance between the center and the periphery of the whirl):

$C_{2u} = k_1U_2$, $k_1 = 0.2 \sim 0.8$,
$A = 0.8 \sim 1.2$; $B = 0 \sim -1.0$; $C = 0$.

(2) When the velocity $W_2$ is related to the second degree function of the peripheral velocity of the rotor 1 at the exit surface 6:

$C_{2u} = k_2U_2^2$; $k_2 = 5 \times 10^{-4} \sim 15 \times 10^{-4}$ (dimension $k_2$ is a reciprocal of the velocity)
$A = 0.8 \sim 1.2$; $B = 0 \sim -1.0$; $C = 0$.

In a radial turbine of the conventional design, the relative velocity $W_2$ is obtained under the condition that in the formula (2), $B=C=0$, namely $\Psi_2=A$ is constant at the turbine exit surface 6. Further, $W_2u$ and $W_2a$ are determined in the formulae (3) and (4) to obtain $\beta_2'$ in the formula (5). $\beta_2'$ thus obtained is used as an angle of rake $\beta_2$ which the cross-section 8 has against the turbine exit surface 6 at the point 7 where the cross-section 8 along an optional line of flow of the combustion gas (line II—II in FIG. 1) intersects with the turbine exit surface 6, in other words, at the point 7 which is distant from the axis 5 of the turbine by $R_2$. But actually, as $\Psi_2$ changes with the distance from the axis 5 of the turbine, there occurs an error difference in the value of the relative velocity $W_2$; accordingly, there occurs a difference between the angle of rake $\beta_2$ which the turbine blade 2 has against the turbine exit surface 6 and the angle of rake $\beta_2'$ which the relative velocity $W_2$ has against the turbine exit surface, which causes the turbine efficiency (the ratio of actual heat drop of combustion gas to perfect heat drop of combustion gas when it does an isoentropic expansion) to decrease.

This invention aims at eliminating the aforementioned drawbacks of conventional radial turbines. According to this invention, therefore, the values of $W_2$, $W_2u$ and $W_2a$ are obtained assuming $\Psi_2=A+B(R_2/R_1)$, and the relative velocity $W_2$ is obtained from those values, and the angle of inclination $\beta_2'=\tan^{-1}W_2a/W_2u$ of the relative velocity $W_2$ relative to the turbine exit surface 6 is adopted as the angle of inclination $\beta_2$ of the turbine blade 2 relative to the turbine exit surface 6. The flow pattern (direction and speed) of combustion gas when $\Psi_2=A+B(R_2/R_1)$ is defined as an approximate flow pattern of combustion gas, since it is closer to the actual flow pattern of combustion gas than when $\Psi_2=A$.

Figure 3:
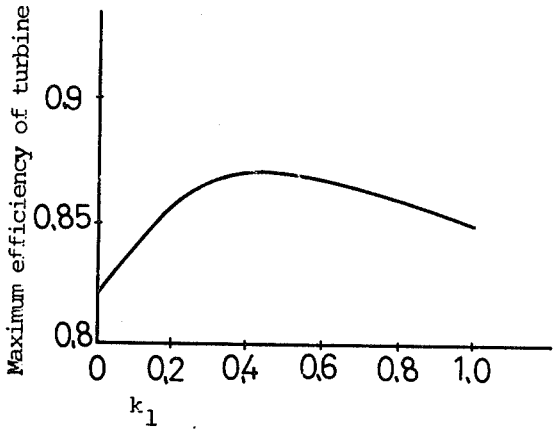
FIG. 3 is a graph showing a curve of theoretical characteristics of the radial turbine of this invention.

FIG. 3 shows the characteristics of the turbine of this invention in which a rigid swirl is present at the exit surface 6. In FIG. 3, the axis of abscissa indicates $k_1$ and the axis of ordinate the maximum efficiency of the turbine. The rigid swirl is present when $C_2u=k_1U_2$. The coefficients A, B and C in the formula (2) are 1.025, −0.456 and 0, respectively, according to the results of experiments. The turbine is operated under the following conditions:

Total pressure at turbine entrance portion 3=24,960 kg/m$^2$.

Total temperature at the turbine entrance portion 3: $T_0=1173°$ K.

Static pressure at the turbine exit portion 11: $P_3=11180$ kg/m$^2$.

Rotational frequency of the turbine rotor: n=86000 rpm.

Figure 4:
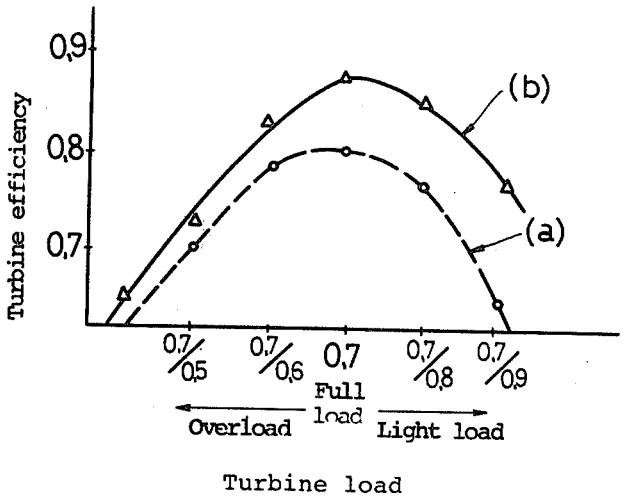
FIG. 4 is a graph comparing the characteristics of the radial turbine of this invention and those of a radial turbine of the conventional design.

In FIG. 4, where turbine load is shown on the axis of abscissa and the turbine efficiency is shown on the axis of ordinate, the results of experiments on the radial turbine embodying this invention under the condition that the swirl of the combustion gas at the turbine exit surface 6 is a solid swirl and that $\Psi_2=A+B(R_2/R_1)$ are shown in comparison with the results of experiments on the radial turbine of conventional design under the condition that $\Psi_2=A$. In this Figure, the curve a shows the results of experiments on the conventional turbine and the curve b shows the results of experiments on the turbine of this invention, in which $k_1$, A and B are 0.3, 1.025 and −0.465, respectively. FIG. 4 shows that the efficiency of a turbine of the present invention is evidently higher than that of a turbine of conventional design.

While the invention has been described with reference to a preferred embodiment thereof, it is to be understood that modifications or variations may be easily made by those skilled in the art without departing from the spirit and scope of this invention as defined by the appended claims.

What is claimed is:

1. A radial turbine having a turbine blade, the angle of rake of which, relative to a turbine exit surface, perpendicular to the axis of the turbine, at a radius $R_2$ from the axis of the turbine at the exit portion, and $\beta_2$ and is obtained by the following formula:

$$\beta_2=\tan^{-1}(W_2a/W_2u),$$

wherein $$W_2u=U_2-C_2u \text{ and i } W_2a=\sqrt{W_2^2-W_2a^2},$$

in which, $W_2u$ and $W_2a$ are peripheral and axial components respectively of $W_2$, which is the velocity of combustion gas relative to the turbine rotor at the circular surface including said radius $R_2$ at a designated rotor velocity, and, $$W_2^2=\psi_2^2\left[W_1^2-U_1^2+U_2^2+2gJC_pT_1\left(1-\left(\frac{P_2}{P_1}\right)^{\frac{\gamma-1}{\gamma}}\right)\right],$$

in which, $$\psi_2=A+B\left(\frac{R_2}{R_1}\right)+C\left(\frac{R_2}{R_1}\right)^2,$$

A, B and C are coefficients, $R_1$=the distance of turbine entrance portion from the axis of the turbine;

$R_2$=the distance between the axis of the turbine and an intersecting point of the turbine exit surface and a cross-section of the turbine blade along a designated line of flow of the combustion gas flowing through a space between two adjacent turbine blades;

$W_1$=the relative velocity between the combustion gas and the turbine rotor at the turbine entrance portion and at the designated rotor velocity;

$U_1$=the peripheral velocity of the turbine rotor at the turbine entrance portion and at the designated rotor velocity;

$U_2$=the peripheral velocity of the turbine rotor at the radius $R_2$ on the turbine exit surface and at the designated rotor velocity;

g=gravitational acceleration;

J=heat equivalent of work;

$C_p$=specific heat at constant pressure of the combustion gas;

$P_1$=the pressure of the combustion gas at the turbine entrance portion and at the designated rotor velocity;

$T_1$=the absolute temperature of the combustion gas at the turbine entrance portion and at the designated rotor velocity;

$P_2$=the pressure of the combustion gas at the circular surface including said radius $R_2$ on the turbine exit surface and at the designated rotor velocity;

$\gamma$=the ratio of the specific heat at constant pressure of the combination gas to the specific heat at constant volume of the combustion gas.

2. An invention as set forth in claim 1, wherein said combustion gas is defined by a formula:

$$\Psi_2 = A + B(R_2/R_1).$$

3. An invention as set forth in claim 2, wherein the circumferential component $W_2u$ of said relative velocity $W_2$ is defined by a formula:

$W_2u = U_2(1 - k_1)$, in which $k_1$ is a constant.

4. An invention as set forth in claim 2, wherein the circumferential component $W_2u$ of said relative velocity $W_2$ is defined by a formula:

$W_2u = U_2(1 - k_2U_2)$, in which $k_2$ is a constant.

* * * * *